United States Patent [19]

Jenne et al.

[11] Patent Number: 4,913,243

[45] Date of Patent: Apr. 3, 1990

[54] PERCUSSION DRILL AND METHOD OF CONTROLLING SAME

[75] Inventors: Gustav Jenne, Essen-Kettwig, Fed. Rep. of Germany; Dietmar Jenne, Strengelbach, Switzerland

[73] Assignee: Terra AG für Tiefbautechnik, Strengelbach

[21] Appl. No.: 292,461

[22] Filed: Dec. 30, 1988

[30] Foreign Application Priority Data

Dec. 30, 1987 [CH] Switzerland ..... 05107/87

[51] Int. Cl.[4] ..... E21B 4/14

[52] U.S. Cl. ..... 175/57; 175/296; 175/92

[58] Field of Search ..... 175/296, 297, 299, 293; 166/178; 173/91, 135, 138, 139

[56] References Cited

U.S. PATENT DOCUMENTS

| | | | |
|---|---|---|---|
| 2,872,158 | 2/1959 | Green | 175/299 |
| 3,692,122 | 9/1972 | Curington | 175/296 X |
| 4,200,158 | 4/1980 | Perkins | 175/296 X |
| 4,361,195 | 11/1982 | Evans | 175/299 X |
| 4,705,118 | 11/1987 | Ennis | 175/296 X |
| 4,785,898 | 11/1988 | Kostyler et al. | 175/296 X |

FOREIGN PATENT DOCUMENTS

| | | |
|---|---|---|
| 2634066 | 2/1978 | Fed. Rep. of Germany . |
| 2722297 | 2/1979 | Fed. Rep. of Germany . |

*Primary Examiner*—Stephen J. Novosad
*Attorney, Agent, or Firm*—Robert W. Becker & Associates

[57] ABSTRACT

A percussion drill provided with additional control phases in the form of a gentle braking phase for controlling the rearward movement, and a progressive braking phase for controlling forward movement. To this end, the control slide valve of the drill has a clearly defined gentle braking control edge, a new type of control channel having a cross-section which is variable along its length. The main advantages which are achieved as a consequence are substantially reduced compressed air consumption, substantially smoother operation even in relatively loose soil, and a considerably prolonged effective life.

14 Claims, 8 Drawing Sheets

PERCUSSION DRILL AND METHOD OF CONTROLLING SAME

BACKGROUND OF THE INVENTION

The present invention relates to a method of controlling the forward and/or rearward movement of a percussion drill for producing holes in soil, including control phases of a reversible slide valve control arrangement. The present invention also relates to a percussion drill for carrying out such a method, with the drill comprising a control device for a flow medium for controlling movement of the drill in the forward and the rearward directions of travel, a housing having a percussion piston disposed in it, the percussion piston striking the housing and being adapted for reciprocating movement therein in response to pressure exerted by the flow medium and comprising an axial guide and lateral control channels which cooperate with control channels of the control device wherein the control device is a rotary slide valve control device, comprising a control slide valve that is disposed for indexed or stepped rotation in a housing closure means and is connected to a flow medium feed pipe of the housing sealing device.

A first prior art percussion drill (DE-PS 26 34 066-Schmidt dated Sept. 20, 1984) comprises a partially hollow percussion piston that is adapted for reciprocating movement in a housing. A reversible control device for a flow medium extends into the hollow percussion piston and controls the movements thereof and thus indirectly also the forward or reverse movements of the percussion drill. The control device is seated in a screw-threaded end piece that seals off one end of the percussion drill housing and through which also the compressed air is supplied and discharged.

The control device is constructed so as to be integral with the screw-threaded end piece and has a stepped control tube, with that end thereof that extends into the hollow portion of the percussion piston, carrying a pot-shaped control sleeve in which are two diametrically disposed elongated axially parallel control slots. A first tubular part of the screw-threaded end piece engages over a thinner part of the control tube, while a second tubular part, constructed as an intermediate control sleeve, engages over the pot-shaped control sleeve, both tubular parts being connected via webs. The percussion piston slides in an axially reciprocating manner on this intermediate control sleeve. The stepped control tube is mounted for stepped rotation in the screw-threaded end piece and its intermediate control sleeve. For cooperation with the elongated control slits in the control tube, the intermediate control sleeve has matching slits, and immediately adjacent to them are discharge slits which make it possible, in appropriate switching positions, for exhaust air to flow out from the space between the percussion piston head and the housing through transverse ports at the end of the percussion piston. However, compressed air also flows through these transverse ports, through the elongated control slits upstream of the percussion piston head until the latter reverses its movement in the housing from the forward direction to the rearward direction. This compressed air brakes or arrests the percussion piston relatively abruptly at its front, dead center position upon reverse movement of the percussion drill, because the air pressure for moving the percussion piston in the direction of the percussion drill head drops abruptly and throughout the rest of the movement, and in return builds up similarly strongly and quickly upstream of the percussion piston head.

A second percussion drill (DE-PS 27 22 297-Tka et al dated Mar. 22, 1984) which was developed after the first drill, comprises a partially hollow percussion piston that is adapted for reciprocating movement in a housing, and a reversible control device, for flow medium, which extends into the percussion piston and controls the movements thereof and thus indirectly also the forward or reverse movement of the percussion drill. The control device is seated in a screw-threaded end piece that seals off one end of the percussion drill housing, with the compressed air also being supplied and discharged through the end piece.

The control device has, seated in the screw-threaded end piece, a stepped and rotatable control tube comprising, on the end thereof which is received in the hollow portion of the percussion piston, an annular control step that projects on the outside surface and has on its free end face two diametrically disposed, elongated, axially parallel control slots which are open at the front end and on which, at the axially corresponding locations on the rear stepped end face, there are elongated control projections that have the same outside diameter as the annular control step. The percussion piston slides thereon in an axially reciprocating manner. Close to that end of the piston which is towards the screw-threaded end piece are two diametrically opposed transverse bores through which, in suitable switching positions, exhaust air can flow out of the space between the percussion piston head and the housing. However, compressed air also flows out through these transverse ports, through the elongated control slots, and upstream of the percussion piston head, until the piston head changes its direction of movement in the housing from the forward direction to the rearward direction. This compressed air which flows in permanently upstream of the percussion piston provides a relatively abrupt braking action for the piston.

This abrupt braking is a substantial disadvantage of both of the prior art percussion drills because in both cases considerable reaction forces act on the housing of the percussion drill during reverse movement, thus resulting in a very uneven and inefficient movement, particularly in soft ground. Furthermore, the compressed air consumption is very high since all of the compressed air which arrives in front of the percussion head flows out to the atmosphere through the screw-threaded end piece and is therefore lost. This constitutes a very high energy loss.

It is therefore an object of the present invention to improve the arrangements for controlling a percussion drill in such a way that the intense and abrupt loadings, and the compressed air consumption, are substantially reduced while at the same time the efficiency of the equipment is improved. It is also an object of the present invention to achieve a decided improvement in the efficiency of a percussion drill when driving a cable or bore hole, in other words during forward movement, by making more percussion energy available without thereby increasing the consumption of compressed air and without having to apply more energy to achieve a higher air pressure.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
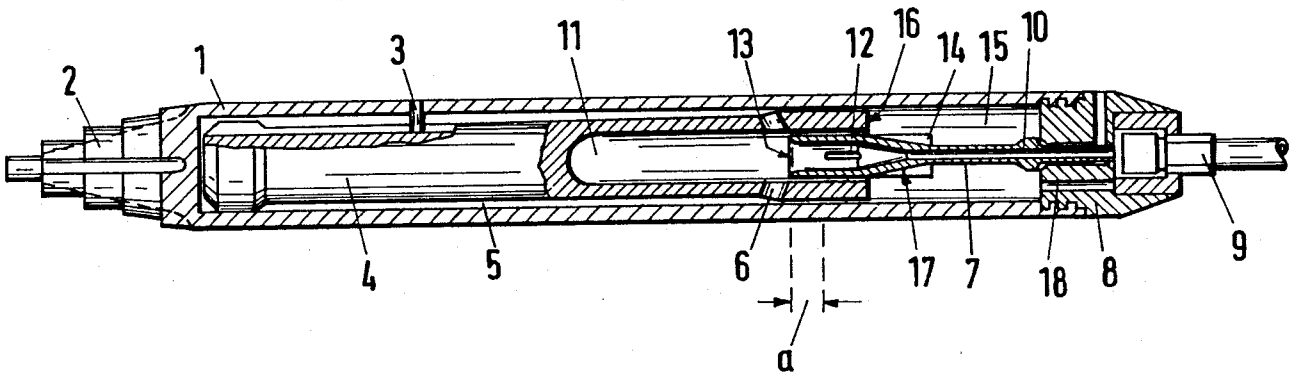
FIG. 1 is a cross-sectional view of one exemplary embodiment of the percussion drill according to the present invention, with the position shown being the forward impact, dead center position of the percussion piston during forward movement of the drill.

The method of the present invention is characterized primarily in that the control process, for operation of the drill in the rearward travel direction, is optimized by incorporating a gentle braking phase, and/or in that the control process, for operation of the drill in the forward travel direction, comprises at least one control phase for progressive braking of the percussion piston, with the discharge of compressed air from the drill being quantitatively controllable as a function of the position of the piston during rearward travel.

The percussion drill of the present invention is characterized primarily in that the control slide valve comprises at least one first control channel disposed at a distance from its end face and at least one second control channel offset in relation to the first control channel in the peripheral direction; a control channel of the percussion piston selectively passes over either of the first and second control channels as required, the control passage of the piston being adapted to be connected to exhaust air passages of the percussion drill; and in that either the distance between the first control channel and the end face of the control slide valve is at least greater than the length of the control passage of the percussion piston, which for controlling rearward travel cooperates with the first control channel, and/or the second control channel is constructed as a quantitative control channel for the measured discharge of flow medium for the control phase with progressive braking of the percussion piston.

Further specific features of the present invention will be described in detail subsequently.

DESCRIPTION OF PREFERRED EMBODIMENTS

Referring now to the drawings in detail, it is intended first to explain the construction of the percussion drill, then the way it works, and afterwards the method of controlling it because this method will be more readily understood when the reader has knowledge of the construction and manner of operation.

Figure 2:
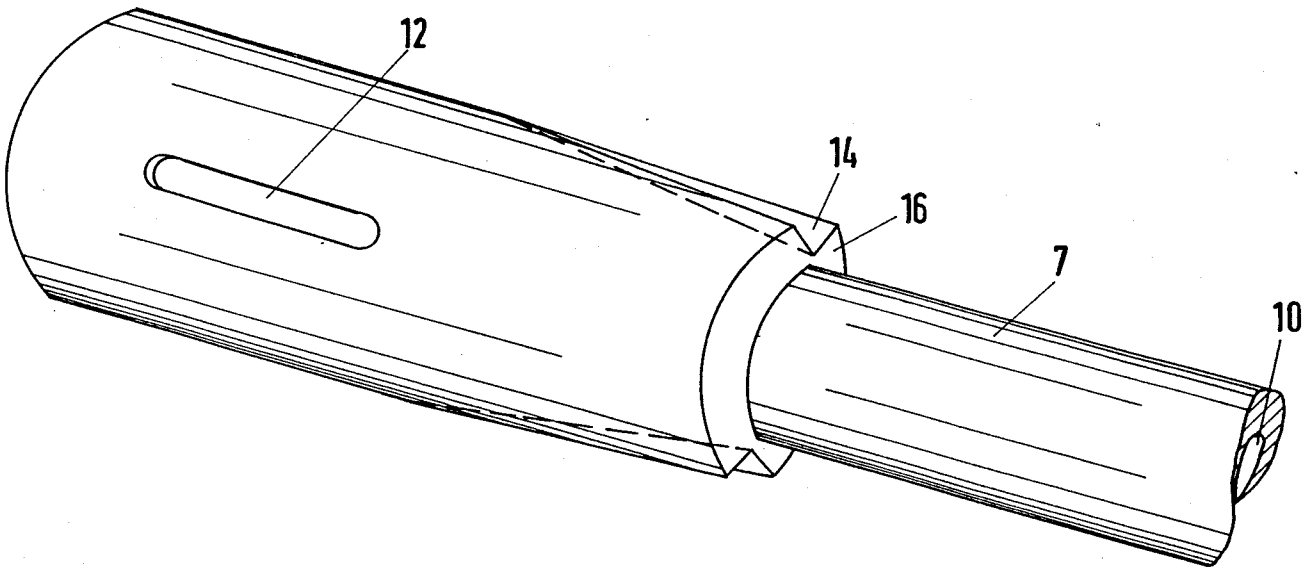
FIG. 2 is a detailed perspective view of a first exemplary embodiment of a control slide valve that forms part of a percussion drill according to the invention.

Referring to FIGS. 1 and 2, a percussion drill comprises a hollow, cylindrical housing 1 having a percussion head 2, and a partly hollow-cylindrical percussion piston 4 that is adapted to be reciprocated or moved back and forth in the housing 1 by means of compressed air as the flow medium and that is maintained parallel with the housing axis by a guide pin 3. On its outside surface, the percussion piston 4 has longitudinally extending transfer ports or channels 5 for compressed air; these channels start at two diametrically opposed transverse bores 6 that are inclined to the percussion piston axis. One end of a control slide valve 7 extends into the hollow, cylindrical end of the percussion piston 4, with the other end of the valve 7 being disposed for indexed or stepped rotation in a screw-threaded end piece 8 which serves to seal the housing 1: the slide valve is however, immovably seated and is operatively connected to a compressed air supply means 9. This supply means also serves as a means of adjusting the rotational position of the control slide valve 7 which has, between a longitudinal slot and an exhaust air port, a sealing ring (not shown) to provide a seal with respect to the percussion piston. Furthermore, the control slide valve 7 has a bore 10 for the compressed air, with that end of the bore that penetrates the hollow end of the percussion piston 4 widening out and opening into the piston chamber or space 11 of the percussion piston 4. In the widened-out portion of the bore 10, the control slide valve 7 has two diametrically disposed longitudinal slots 12 that are disposed at a distance (a) from the end face 13 of the control slide valve 7. This distance (a) is preferably at least greater than the longitudinal dimension of the control channel, i.e. the transverse bore 6, that cooperates with the first control channel or slot 12. Two diametrical exhaust air channels 14 are disposed in the control slide valve 7 at those ends of the longitudinal slots 12 that are remote from the end face 13; the channels 14 are disposed adjacent to the slots 12 but are preferably offset therefrom by 90°. These exhaust air channels 14 discharge air into the exhaust air space 15 between the screw-threaded end piece 8 and the end 16 of the percussion piston 4 opposite the end piece 8. The transverse cross-sectional areas of the channels 14 steadily increase from the end at which the longitudinal slots 12 are provided towards the end at which the screw-threaded end piece 8 is situated. In particular, this transverse cross-section is triangular, but it can also be of any other suitable shape. Furthermore, the generatrix 17 of the surfaces of the channels 14 need not be flat or linear, but may follow any desired concave or convex curve. What is essential however is that the exhaust air channel at its end closest to the longitudinal slots, should end virtually in a point, and that from there its cross-section should increase axially only very slowly in a peripheral zone and then discharge into the exhaust air space 15, which is connected to the atmosphere via air outlet passages 18.

The mode of operation of the control device for the percussion drill will initially be described for forward travel, i.e. movement of the percussion drill into the ground or soil, that is for the actual drilling process.

Figure 3:
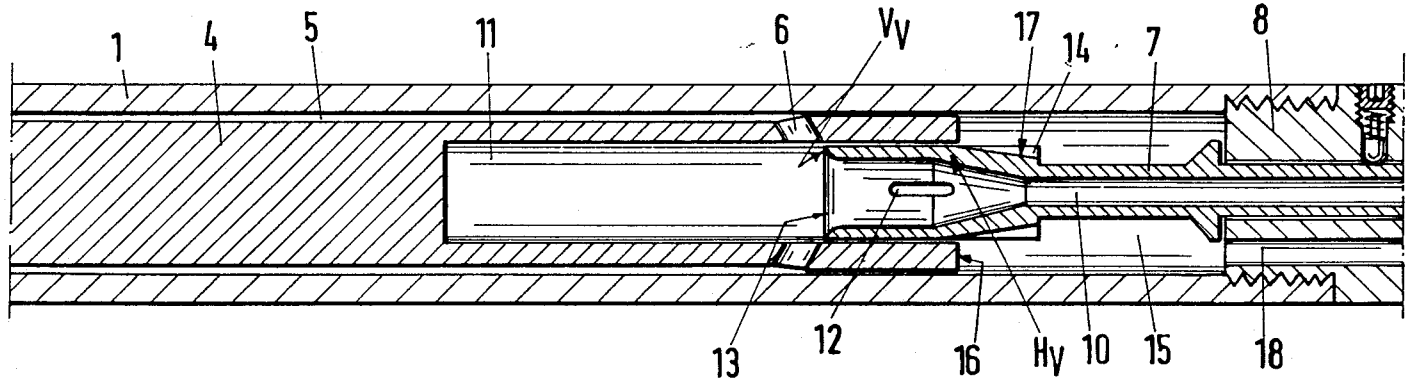
FIG. 3 is a detailed cross-sectional view of the percussion drill in the region of the control slide valve according to FIG. 1 during forward movement, after commencement of the changeover to rearward movement of the percussion piston.
Figures 4, 4A:
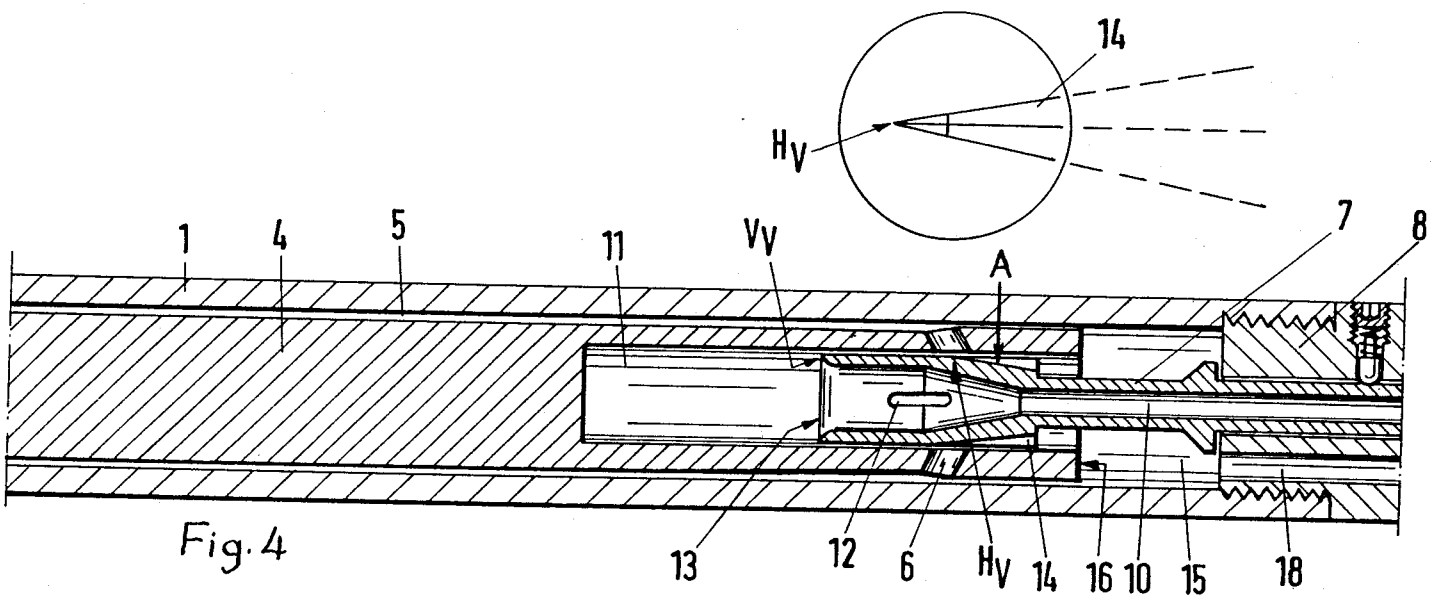
FIG. 4 is a detailed view of the percussion drill according to FIG. 3 during forward movement, after commencement of the control phase for progressive braking of the FIG. 4A is an enlarged fragmentary in the direction of arrow A in FIG. 4.

Referring to FIGS. 3 and 4, assuming that the percussion piston 4 is positioned with its head located at the percussion head end of the housing 1 and abutting against this housing, the transverse bores 6 are, generally speaking, at a distance in front of the leading edge $V_v$, with respect to forward travel, of the control slide valve 7. The slide valve is in a position in which the longitudinal slots 12 are offset by 90° with respect to the transverse bores 6. If compressed air is flowing through the bore 10 of the control slide valve 7, then the air passes through the transverse bore 6 and along the transfer channels 5 upstream of the head of the percussion piston 4 on which, by virtue of the different surface areas of the percussion piston head and of its inner cylindrical cross-section in the piston space 11, the air exerts a repulsive force on the percussion piston 4. The piston is accelerated and moves rearwardly towards the screw-threaded end piece 8 until the transverse bores 6 move beyond the leading edge $V_v$. Movement of the percussion piston 4 is now slowed by the compressed air present in the piston space 11 and, by virtue of its kinetic energy, the piston 4 continues to slide, with the transverse bore 6 moving beyond the trailing edge $H_v$, with respect to forward travel, of the control slide. As a result of the fact that the exhaust air channels 14 virtually commence with zero cross-section, the control phase for progressive braking of the percussion piston 4 commences with the discharge of exhaust air. Thus, the percussion piston 4 is progressively slowed or braked in that initially the dispensed or regulated discharge of exhaust air produces only a minimal pressure drop on the upstream side of the head of the percussion piston 4, so that the piston loses little kinetic energy and thus travels a greater distance, before reaching its rear dead center position of reverse movement at which it is completely braked and the pressure drop is completed than is the case in the prior art where there is an abrupt pressure drop at the trailing edge $H_v$, with respect to forward travel. Thus, there also is a greater distance available for the subsequent acceleration of the percussion piston 4 during its forward movement prior to impact, than in the equipment according to the state of the art. Therefore, this produces substantially more kinetic energy for the percussion piston 4 and thus more powerful impacts, i.e. a greater forward travel per impact, than with prior art equipment. This means a substantially enhanced efficiency since both working time and compressed air, i.e. energy, can be saved due to there being fewer impacts per unit length of the bore hole. Starting from this rear dead center position, the percussion piston 4, as mentioned, is accelerated and, shortly after it runs over the leading edge $V_v$, with respect to forward travel, of the control slide valve 7, it strikes the percussion head. This is followed by the next impact cycle for forward movement operation of the percussion drill.

Figure 5:
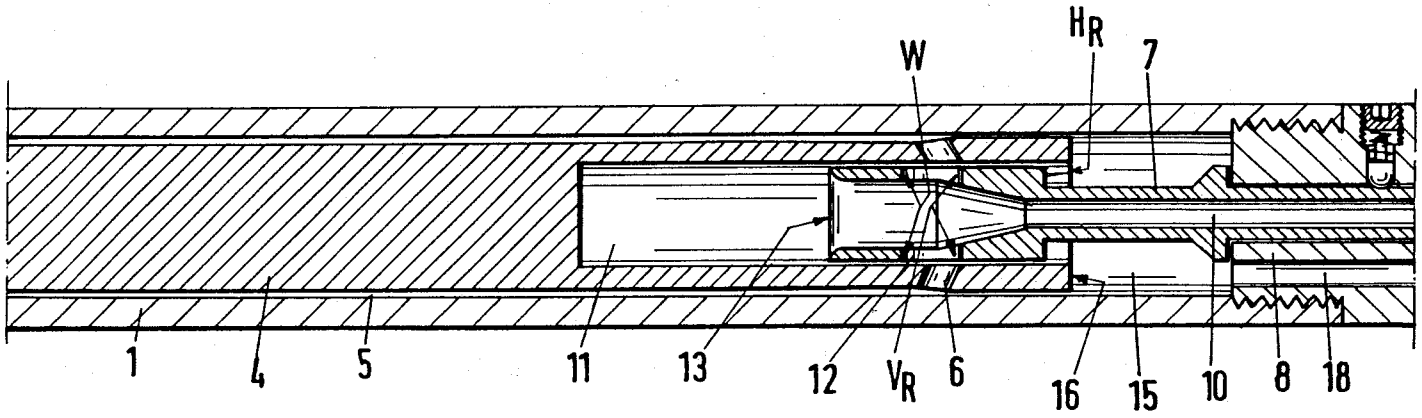
FIG. 5 is a detailed view of the percussion drill according to FIG. 3 during reverse movement, after commencement of the braking phase.
Figure 6:
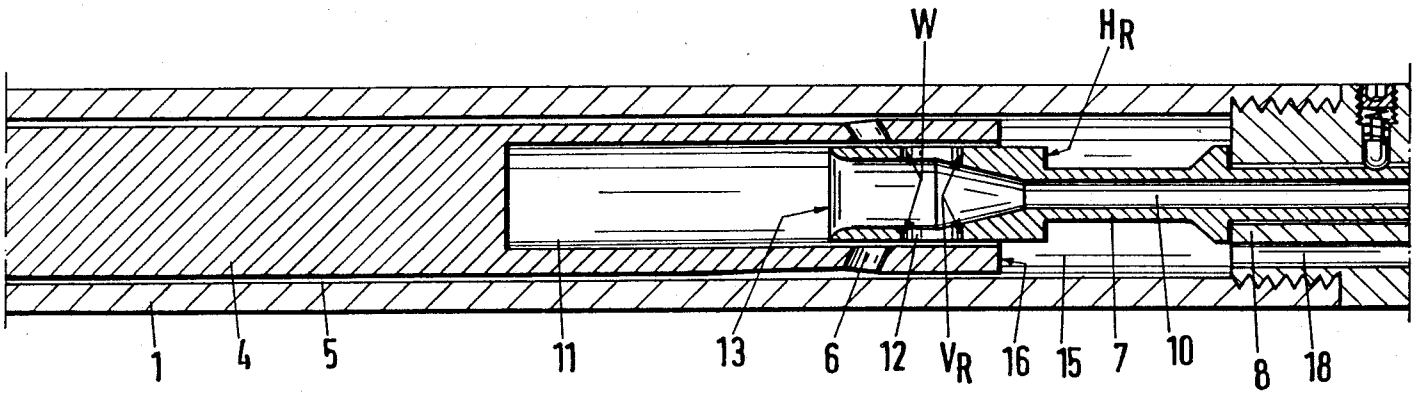
FIG. 6 is a detailed view of the percussion drill according to FIG. 4 during reverse travel, after commencement of the gentle braking phase.
Figure 7:
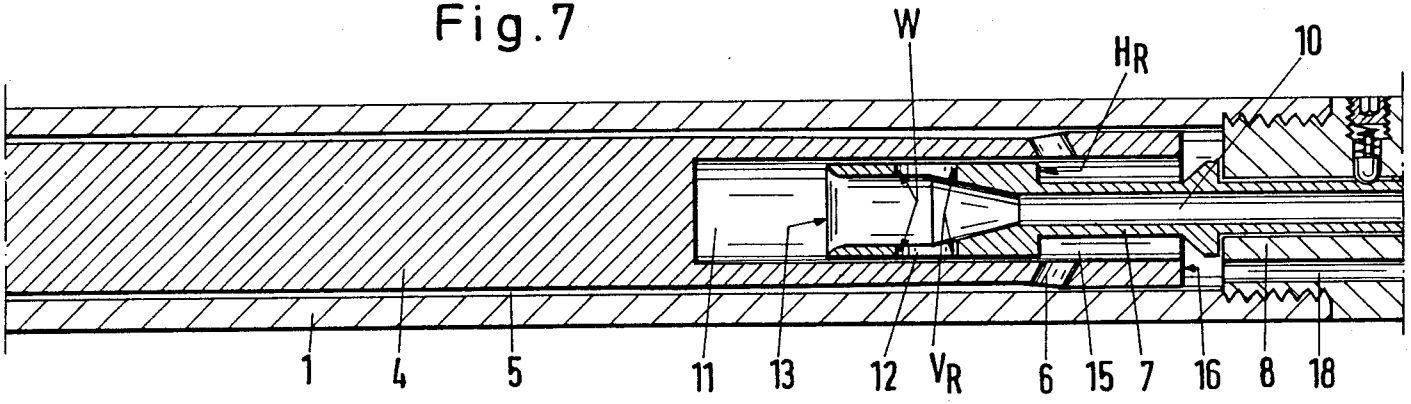
FIG. 7 is a detailed view of the percussion drill according to FIG. 5, during reverse travel, after commencement of discharge of exhaust air and prior to the percussion piston striking the screw-threaded end piece.

Referring to FIGS. 5, 6 and 7, for reverse or rearward travel of the percussion drill, for example when producing a blind hole, in order to be able to withdraw the drill from the hole, let it be assumed that the percussion piston 4 is in its rearmost position, i.e. closer to the screwthreaded end piece. In comparison with the setting for forward travel the control slide valve 7 is rotated by 90°, so that the longitudinal slots 12 can cooperate with the transverse bores 6 so that air can flow through. As compressed air flows in through the bore 10, the compressed air passes into the piston space 11 and the percussion piston 4 is accelerated in the direction of the percussion head 2. During this forward movement, each transverse bore 6 runs over the corresponding leading edge $V_4$, with respect to rearward travel, which is on the same side of the longitudinal slot 12 as the screwthreaded end piece. As long as the transverse bores 6 are disposed over the longitudinal slots 12, compressed air flows through the two bores 6 into the transfer channels 5 and in front of the head of the percussion piston 4, so that the forward movement is intensely braked, but not completely, so that the percussion piston 4 is still allowed to run over the end edges of the longitudinal slots 12, the gentle braking edges W, without however running over the end face 13 of the control piston, i.e. without reaching the forward dead center position of movement during movement along the distance (a). During this phase of movement, no compressed air arrives in front of the head of the percussion piston 4, so that braking takes place more gently than when there is a permanent supply of compressed air upstream of the head, as with prior art equipment. By virtue of the length of the longitudinal slots 12, the braking phase can be monitored and controlled in conjunction with the distance (a). By virtue of the energy stored in the air cushion upstream of the head of the percussion piston 4, the return of the piston is accelerated until its transverse bores 6 pass beyond the trailing edge $H_r$, with respect to rearward travel, and the air can escape to the atmosphere from the air cushion via the exhaust air space 15 and the air outlet passages 18, as a result of which the end of the percussion piston 4 which is at the same end as the screw-threaded end piece strikes the screw-threaded end piece 8, so that the percussion drill can move backward out of the bore hole. This is followed by a new percussion cycle.

The gentle braking phase, which is controlled by the length of the longitudinal slots 12 in conjunction with the distance (a), ensures a substantially reduced loading on the percussion drill than was possible with prior art equipment; this is reflected in a substantially increased effective life. Furthermore, the gentle braking phase that can be controlled in this way achieves a substantially reduced consumption of compressed air, resulting in lower running costs. The lower reaction forces on the housing during the braking phase produce a smoother reverse or rearward travel, even in loose or wet soil, and builds up only negligible shell friction. Furthermore, the control slide valve is substantially more stable, which in turn makes for a longer working life. In addition, the control slide valve can be more accurately produced.

In the case of a percussion drill that has a gentle braking phase during reverse travel, and a progressive braking phase during forward travel, overall the following advantages can be enjoyed; lower running costs, shorter working times, and increased working life.

With regard to the method of controlling the forward movement of the percussion drill, starting from a percussion piston position to the rear, i.e. when the percussion piston 4 is in the vicinity of the screw-threaded end piece 8, air is fed to the piston chamber 11 causing the percussion piston 4 to be accelerated in a forward direction, toward the percussion head 2, until the transverse bores 6 pass beyond the leading edge $V_v$, whereby compressed air is forced through the bores 6 and through the transfer channels 5 upstream of the front face of the percussion piston. This takes place just prior to the percussion piston 4 striking the percussion head 2. Due to the build-up of pressure on that end face of the percussion piston 4 which faces the percussion head, the return movement is accelerated, the transverse bores 6 first passing the leading edge $V_v$ and immediately afterwards the trailing edge $H_v$. It is at this point that the control phase of the progressive braking of the percussion piston 4 during return in the forward movement-impact cycle commences. Since the exhaust air channels 14, just after they are covered by the transverse bores 6, have an extremely small cross-section so as to initiate this progressive braking phase compared with the large cross-section exhaust air channels which are used in the control method according to the state of the art), initially only very little air is discharged, the quantity increasing gradually according to the configuration of the exhaust air channels 14. This means that the percussion piston 4 has a higher kinetic energy for substantially longer than in the case of an exhaust air channel which is of large cross-section. Thus, its dead center position for reversal of movement is shifted substantially farther to the rear, i.e. closer to the screw-threaded end piece 8. The greater distance of this rear dead center position, in relation to the leading edge $V_v$, which represents the forward point of reversal, gives rise to a substantially higher percussion piston speed at the end of the longer acceleration path, and thus to a more powerful impact. Thus, one impact cycle, for forward travel, is concluded.

In the case of the control method for the reverse or rearward movement of the percussion drill, again starting from a percussion piston position to the rear, i.e. in a percussion piston position close to the screw-threaded end piece 8, the supply of compressed air again accelerates the percussion piston 4 in a forward direction, toward the percussion head 2, until the transverse bores 6 pass over the leading edge $V_r$, with respect to reverse travel, of the control slide valve 7. From this moment onward, compressed air is passed through the longitudinal slots 12 and the transfer channels 5 upstream of the percussion piston 4, and the braking phase is initiated. By virtue of the approximately selected length of the longitudinal slots 12, the percussion piston 4 is guided over the end edges of the longitudinal slots 12, the gentle braking edges W, and is gently braked within the distance (a) between the edges W and the end face 13 of the control slide valve 7 by the cushion of air that still remains upstream of the percussion piston 4 even though no further compressed air has been supplied. Afterward, the air cushion accelerates the percussion piston in its return stroke until the piston passes over the trailing edge $H_r$, with respect to return travel, of the control slide valve 7, and the air of the air cushion escapes to the atmosphere via the transverse bores 6, the exhaust air space 15, and the air outlet channels 18, shortly after which the piston strikes the screw-threaded end piece 8 in an unbraked condition, causing the percussion drill to be propelled out of the bore hole. The next impact cycle for the reverse travel of the percussion drill then commences.

Figure 8:
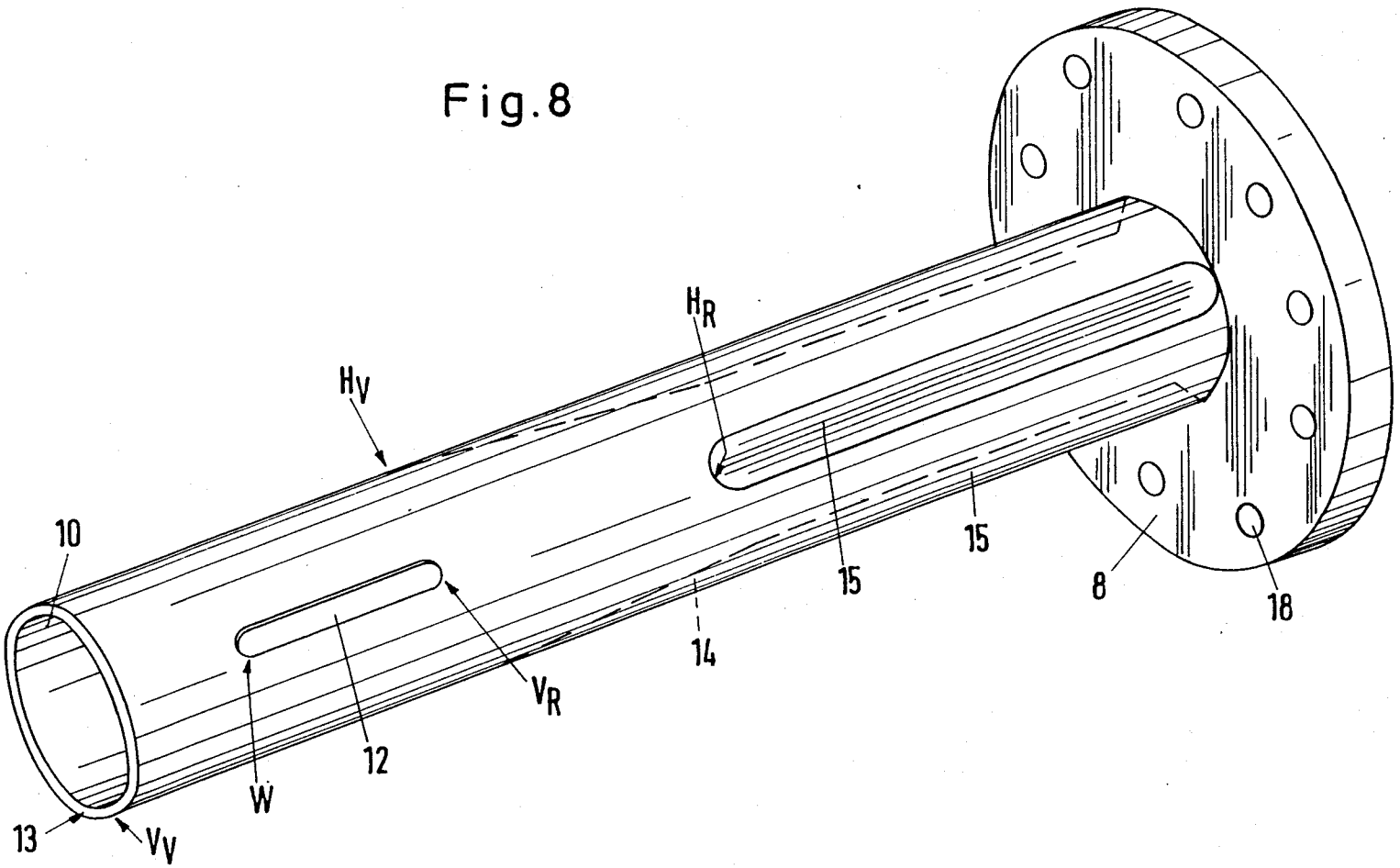
FIG. 8 shows a second exemplary embodiment of the control slide valve.

In a second embodiment, shown in FIG. 8, the control slide valve 7 can be constructed without a step or shoulder behind the longitudinal slots 12 and the exhaust air channels 14, which instead may open out into exhaust air passages 15 that are adjacent to the air outlet channels 18 of the screw-threaded end piece 8. Such a construction of the control slide valve 7 has the advantage that it is more stable, so that wear and tear in the control portion is reduced, resulting in an increased working life and an improved functioning, even after many hours of operation.

The present invention is, of course, in no way restricted to the specific disclosure of the specification and drawings, but also encompasses any modifications within the scope of the appended claims.

What we claim is:

1. A method for controlling a percussion drill with a percussion piston for producing holes in soil, with the control process including control phases of a reversible slide valve control arrangement; said method comprising the improvement therewith which includes the step of:

optimizing the control process for operating of said drill in a rearward direction of travel by incorporating a gentle braking phase effective upon the percussion piston during the rearward direction of travel thereof.

2. A method for controlling a percussion drill with a percussion piston for producing holes in soil, with the control process including control phases of a reversible slide valve control arrangement; said method comprising the improvement therewith which includes the step of:

providing the control process for operation of said drill in a forward direction of travel with at least one control phase for progressive braking of the percussion piston of said drill effective upon the percussion piston during the rearward direction of travel thereof, with discharge of compressed air from said drill being quantitatively controllable as a function of the position of said percussion piston during rearward travel thereof.

3. A method for controlling a percussion drill with a percussion piston for producing holes in soil, with the control process including control phases of a reversible slide valve control arrangement; said method comprising the improvement therewith which includes the steps of:

optimizing the control process for operation of said drill in a rearward direction of travel by incorporating a gentle braking phase effective upon the percussion piston during the rearward direction of travel thereof; and providing the control process for operation of said drill in a forward direction of travel with at least one control phase for progressive braking of the percussion piston of said drill, with discharge of compressed air from said drill being quantitatively controllable as a function of the position of said percussion piston during rearward travel.

4. A percussion drill for producing holes in soil, said drill comprising:

a housing having a percussion head at one end thereof, and closure means at an opposite end thereof, with said housing also including exhaust air passage means leading from the interior to the exterior of said housing;

a control device, in the form of a rotary slide valve, disposed within said housing and, for indexed rotation, in said closure means; said slide valve is connected to a flow medium feed line for receiving flow medium to effect control of movement of said drill in a forward and rearward direction of travel; said slide valve has an end face remote from said closure means, and is provided with at least one first control channel, which is disposed at a given distance from said valve end face, and at least one second control channel, which is offset relative to said first control channel in a peripheral direction; and a percussion piston disposed in said housing, at least partially between said end face of said slide valve and said percussion head of said housing, in such a way as to be reciprocably movable in said housing in response to pressure exerted by said flow medium, with said piston being adapted to strike said housing, which includes means to axially quide said piston therein: said piston is provided with lateral control channel means that is adapted to selectively cooperate with either said first or second control channels of said slide valve by passing over same, and is also adapted to cooperate with said exhaust air passage means of said housing; said distance of said first control channel from said end face of said slide valve is at least greater than the length of said control channel means of said piston, which for controlling rearward travel of said drill cooperates with said first control channel.

5. A percussion drill for producing holes in soil, said drill comprising:

a housing having a percussion head at one end thereof, and closure means at an opposite end thereof, with said housing also including exhaust air passage means leading from the interior to the exterior of said housing;

a control device, in the form of a rotary slide valve, disposed within said housing and, for indexed rotation, in said closure means; said slide valve is connected to a flow medium feed line for receiving flow medium to effect control of movement of said drill in a forward and rearward direction of travel; said slide valve has an end face remote from said closure means, and is provided with at least one first control channel, which is disposed at a given distance from said valve end face, and at least one second control channel, which is offset relative to said first control channel in a peripheral direction; and a percussion piston disposed in said housing, at least partially between said end face of said slide valve and said percussion head of said housing, in such a way as to be reciprocably movable in said housing in response to pressure exerted by said flow medium, with said piston being adapted to strike said housing, which includes means to axially guide said piston therein: said piston is provided with lateral control channel means that is adapted to selectively cooperate with either said first or second control channels of said slide valve by passing over same, and is also adapted to cooperate with said exhaust air passage means of said housing; said second control channel is embodied as a quantitative control channel for measured discharge of said flow medium for a progressive braking control phase of said piston, which for forward travel of said drill cooperates with said second control channel.

6. A percussion drill for producing holes in soil, said drill comprising:

a housing having a percussion head at one end thereof, and closure means at an opposite end thereof, with said housing also including exhaust air passage means leading from the interior to the exterior of said housing;

a control device, in the form of a rotary slide valve, disposed within said housing and, for indexed rotation, in said closure means; said slide valve is connected to a flow medium feed line for receiving flow medium to effect control of movement of said drill in a forward and rearward direction of travel; said slide valve has an end face remote from said closure means, and is provided with at least one first control channel which is disposed at a given distance from said valve end face, and at least one second control channel, which is offset relative to said first control channel in a peripheral direction; and a percussion piston disposed in said housing, at least partially between said end face of said slide valve and said percussion head of said housing, in such a way as to be reciprocably movable in said housing in response to pressure exerted by said flow medium, with said piston being adapted to strike said housing, which includes means to axially guide said piston therein; said piston is provided with lateral control channel means that is adapted to selectively cooperate with either said first or second control channels of said slide valve by passing over same, and is also adapted to cooperate with said exhaust air passage means of said housing; said distance of said first control channel from said end face of said slide valve is at least greater than the length of said control channel means of said piston, which for controlling rearward travel of said drill cooperates with said first control channel; said second control channel is embodied as a quantitative control channel for measured discharge of said flow medium for a progressive braking control phase of said piston, which for forward travel of said drill cooperates with said second control channel.

7. A percussion drill according to claim 6, in which at least portions of said second control channel have a cross-sectional configuration that increases in a longitudinal direction.

8. A percussion drill according to claim 7, in which said cross-sectional configuration of said second control channel increases in conformity with a concave generatrix.

9. A percussion drill according to claim 7, in which said cross-sectional configuration of said second control channel increases in conformity with a convex generatrix.

10. A percussion drill according to claim 7, in which said cross-sectional configuration of said second control channel increases in conformity with a linear generatrix.

11. A percussion drill according to claim 7, in which said second control channel has an essentially triangular cross-sectional configuration.

12. A percussion drill according to claim 7, in which said second control channel has an essentially arcuate cross-sectional configuration.

13. A percussion drill according to claim 6, in which said control channel means of said piston is at least one bore, which is inclined at an angle relative to a central axis of said piston

14. A percussion drill according to claim 6, in which said first control channel of said slide valve has a width that is equal to only approximately half the width of said control channel means of said piston.

* * * * *